US005184743A

United States Patent [19]

Suzuki et al.

[11] Patent Number: 5,184,743

[45] Date of Patent: Feb. 9, 1993

[54] CONTAINER FOR HOUSING COIL

[75] Inventors: Takashi Suzuki, Yokohama; Kohei Fukui, Tokyo, both of Japan

[73] Assignees: Nissin Technos Corporation, Kanagawa Pref.; Cotra System Kabushiki Kaisha, Tokyo, both of Japan

[21] Appl. No.: 923,852

[22] Filed: Jul. 31, 1992

[30] Foreign Application Priority Data

Aug. 21, 1991 [JP] Japan ..... 3-234160

[51] Int. Cl.[5] ..... B65D 85/04

[52] U.S. Cl. ..... 220/1.5; 220/8; 206/389

[58] Field of Search ..... 220/1.5, 8; 206/303, 206/389, 408, 409

[56] References Cited

U.S. PATENT DOCUMENTS

| | | | |
|---|---|---|---|
| 3,830,381 | 8/1974 | Bodenheimer et al. | 220/8 X |
| 4,257,523 | 3/1981 | Blasio | 206/303 |
| 4,714,169 | 12/1987 | Keenan et al. | 220/8 |
| 4,732,528 | 3/1988 | Good | 206/389 X |
| 4,805,794 | 2/1989 | Tsuchiya et al. | |
| 4,901,855 | 2/1990 | Furukawa | 206/389 |
| 5,111,950 | 5/1992 | Wylenzek | 220/1.5 |

FOREIGN PATENT DOCUMENTS

| | | |
|---|---|---|
| 0294629 | 11/1991 | European Pat. Off. . |
| 2-53306 | 11/1990 | Japan . |

*Primary Examiner*—Steven M. Pollard

*Attorney, Agent, or Firm*—Frishauf, Holtz, Goodman & Woodward

[57] ABSTRACT

A container for housing a coil, which comprises: a lower box (2) made of steel, having a bottom wall and an open upper end, for housing a coil with the axis thereof directed horizontally and covering a lower half portion thereof; an upper box (3) made of steel, inserted outside the lower box (2) so as to vertically movable, for covering an upper half portion of the coil, which has an open lower end and an upper end which is openable and closeable by means of a pair of cover plates (4, 4'); and a fixing mechanism for securing the upper box (3) at the uppermost position thereof onto the lower box (2).

2 Claims, 7 Drawing Sheets

CONTAINER FOR HOUSING COIL

REFERENCE TO PATENTS, APPLICATIONS AND PUBLICATIONS PERTINENT TO THE INVENTION

As far as we know, there is available the following prior art document pertinent to the present invention:

(1) Japanese Patent Publication No. 2-53,306 dated Nov. 16, 1990.

The above-mentioned Japanese Patent Publication No. 2-53,306 corresponds to the U.S. Pat. No. 4,805,794 dated Feb. 21, 1989 and the European Patent No. 0,294,629 dated Nov. 13, 1991.

The contents of the prior art disclosed in the above-mentioned prior art document will be discussed hereafter under the heading of the "BACKGROUND OF THE INVENTION."

BACKGROUND OF THE INVENTION

1. Field of the Invention

The present invention relates to a container for housing a coil, which is used when transporting a coil such as a metal strip coil or a paper coil 2. Related Art Statement When transporting for example a steel strip coil manufactured in a steel works from the steel works to a customer, it is necessary to package the coil to prevent flaws or rust from producing on the coil and dust from depositing thereon. When transporting a steel strip coil by sea, in particular, the coil must be doubly packaged with the use of a water-proof paper and a thin steel sheet.

An example of the process in the case where the coils doubly packaged as described above are transported from a steel works in Japan to an overseas customer is described below.

The doubly packaged coils are transported from a steel works to a bonded warehouse near a shipping port, and are piled up into a plurality of piles in the bonded warehouse for storage. When a freight vessel arrives, the coils stored in the bonded warehouse are transferred into a hold of the freight vessel, and are piled up into a plurality of piles in the hold. The freight vessel loaded with the piled coils departs from the shipping port, and reaches a port near a destination. At the port, the coils are unloaded from the freight vessel, and the unloaded coils are transported by means of a special wagon for coils or the like to the destination.

The conventional packaging and transportation of the coils as described above, have the following problems:

(1) The necessity of double packaging of the coil with the use of a water-proof paper and a thin steel sheet requires much labor, time, materials and cost.

(2) Since loading, unloading and transportation of the coils are carried out a plurality of times during transportation of the coils from the steel works to the final destination, flaws may be easily produced on the coils during handling thereof, and rain considerably reduces the stevedoring operation efficiency of the coils.

(3) Stabilization of the coils piled up into a plurality of piles in the bonded warehouse or in the hold of the freight vessel, requires many stoppers corresponding to the coil size, and the coils piled up into a plurality of piles in the hold of the freight vessel must be fixed to each other by means of ropes in a large quantity.

(4) When the freight vessel on the voyage suffers from a stormy weather or a rough sea, the ropes fixing the coils piled up into a plurality of piles in the hold are loosened, and the coils conflict with each other, causing flaws on the coils. When rolling and pitching of the freight vessel are serious, furthermore, the ropes fixing the coils may be broken and the released coils may be scattered about in the hold, resulting in the impossibility of gathering them.

(5) In order to transport the unloaded coils on land, it is necessary to use a special wagon for coils, and to transport them by rail. The quantity of transported coils is therefore limited.

As a container for housing a coil which solves the above-mentioned problems, Japanese Patent Publication No. 2-53,306 dated Nov. 16, 1990 discloses a container for housing a metal strip coil, which comprises:

a lower box made of steel for housing a metal strip coil with the axis thereof directed horizontally and covering a lower half portion thereof, said lower box having an open upper end;

an upper box made of steel inserted into said lower box so as to be vertically movable in said lower box, for covering an upper half portion of said coil, said upper box having an open lower end and an upper end openable and closeable by means of a pair of shutters;

a lift mechanism for vertically moving said upper box; and a shutter opening-closing mechanism for closing said upper end of said upper box by closing said pair of shutters when said upper box is moved up by means of said lift mechanism, and for opening said upper end of said upper box by opening said pair of shutters when said upper box is moved down by means of said lift mechanism (hereinafter referred to as the "prior art").

FIG. 7 is a partially cutaway schematic front view illustrating an example of the container of the above-mentioned prior art, and FIG. 8 is a partially cutaway schematic side view illustrating the container shown in FIG. 7. As shown in FIGS. 7 and 8, the container of the prior art comprises a lower box 33 made of steel, having an open upper end, for housing a metal strip coil 1 with the axis thereof directed horizontally and covering a lower half portion thereof; an upper box 34 made of steel, inserted into the lower box 33 so as to be vertically movable in the lower box 33, for covering an upper half portion of the coil 1, which has an open lower end and an upper end which is openable and closeable by means of a pair of shutters 35, 35'; a lift mechanism for vertically moving the upper box 34; and a shutter opening-closing mechanism for closing the upper end of the upper box 34 by closing the pair of shutters 35, 35' when the upper box 34 is moved up by means of the lift mechanism, and for opening the upper end of the upper box 34 by opening the pair of shutters 35, 35' when the upper box 34 is moved down by means of the lift mechanism.

The lower box 33 comprises a rectangular bottom wall 36 formed, of channel-shaped steel members for example, into a lattice, four lower side walls 37 made of a steel sheet, an open upper end, and four lower props 38 made of steel, having an L-shaped cross section, each fixed vertically to each of four corners of the bottom wall 36. A plurality of coil supports 39 are provided on the bottom wall 36 for stationarily supporting the coil 1 housed in the lower box 33.

The upper box 34 has a rectangular cross section. The upper box 34 comprises four upper side walls 40 made of a steel sheet, an open lower end, and an upper end openable and closeable by means of the pair of shutters 35, 35'. The upper box 34 is inserted into the lower box 33 so as to be vertically movable along the four lower props 38 of the lower box 33.

The lift mechanism for vertically moving the upper box 34 comprises four cylinders 41, four hollow pistons 42, and an air supply pipe 43. Each of the four cylinders 41 is vertically fixed to each of the four corners of the upper box 34. The lower end of each of the four pistons 42 is fixed to each of the four corners of the bottom wall 36 of the lower box 33. Each of the four pistons 42 has a piston head 45 having a through-hole 44 at the center thereof, and each of the piston heads 45 is slidably and vertically inserted into each of the cylinders 41.

The shutter opening-closing mechanism comprises a pair of guide rails 46, symmetrically provided on the inner surfaces of a set of the two opposing upper side walls 40 of the upper box 34, for symmetrically guiding the pair of shutters 35, 35', a pair of shutter rewinding rollers 47 each provided on each of the both sides of the bottom wall 36 of the lower box 33, for rewinding respectively each of the pair of shutters 35, 35', and four ropes 48, one end of each of which is fixed to each of the both sides of the leading end of each of the pair of shutters 35, 35' and the other end of each of which is fixed to the lower portion of the upper box 34. Each of the four ropes 48 is stretched along each of the pair of guide rails 46, the upper side wall 40 of the upper box 34 and the bottom wall 36 of the lower box 33. In FIG. 7, 49 is a shutter casing for receiving each of the pair of shutter rewinding rollers 47.

According to the container for housing a metal strip coil of the prior art, the coil 1 is housed in the container as described herebelow. As shown by a two-point chain line in FIG. 7, the upper box 34 is moved down into the lower box 33. In this position, a greater part of each of the pair of shutters 35, 35' are rewound on each of the pair of shutter rewinding rollers 47, and thus; the upper end of the upper box 34 is opened. In this state, the coil 1 is housed in the lower box 33 with the axis of the coil 1 directed horizontally, and is stationarily supported by means of the plurality of coil supports 39 provided on the bottom wall 36 of the lower box 33. Then, a compressed air is supplied into each of the four cylinders 41 through the air supply pipe 43, the hollow piston 42 and the through-hole 44 of the piston head 45. As a result, the upper box 34 is moved up to the uppermost position thereof along the four lower props 38 of the lower box 33 under the effect of pressure of the compressed air thus supplied.

As described above, according as the upper box 34 is moved up, the pair of shutters 35, 35' are pulled by the four ropes 48 and are symmetrically veered out from the pair of shutter rewinding rollers 47 along the pair of guide rails 46. The leading ends of the pair of shutters 35, 35' finally come into contact with each other at the center of the pair of guide rails 46. Thus, the upper end of the upper box 34 is closed, and the coil 1 is completely housed in the container.

The container in which the coil 1 is housed as described above is transported by sea and on land to the final destination, where the coil 1 is taken out from the container as described below. Air in the four cylinders 41 is discharged through the through-hole 44 of the piston head 45, the hollow piston 42 and the air supply pipe 43. As a result, the upper box 34 moves down into the lower box 33, under the effect of its own weight, along the four lower props 38 of the lower box 33. According as the upper box 34 moves down, the four ropes 48 are loosened, and as a result, the pair of shutters 35, 35' having closed the upper end of the upper box 34 are rewound by means of the pair of shutter rewinding rollers 47. Thus, the upper box 34 moves down into the lower box 33, and the upper end of the upper box 34 is opened. The coil 1 can therefore be easily taken out from the lower box 33 with the use of a crane or the like.

According to the prior art described above, favorable effects are available. More specifically, it is possible to simplify the packaging of the coil 1, to prevent the production of flaws on the coil 1 during the handling and the transportation thereof, to conduct the handling of the coil even in rain, to transport the coil on land without using a special wagon for coils, and thus to improve the transporting efficiency of the coil.

However, the above-mentioned prior art has the following problems:

(1) The lift mechanism for vertically moving the upper box 34 inserted into the lower box 33 and the shutter opening-closing mechanism for opening and closing the upper end of the upper box 34 have very complicated structures. Troubles tend therefore to occur in the lift mechanism and the shutter opening-closing mechanism, and the manufacturing cost of the container increases.

(2) Even when the upper end of the upper box 34 is closed by moving up the upper box 34 and closing the pair of shutters 35, 35', gaps exist between the lower box 33 and the upper box 34 inserted into the lower box 33, and between the pair of shutters 35, 35' closing the upper end of the upper box 34 and the four upper side walls 40 of the upper box 34. Rain water, for example, penetrates into the container through the above-mentioned gaps, and this may cause the production of rust on the coil 1 housed in the container.

Under such circumstances, there is a strong demand for the development of a container for housing a coil, which permits the simplification of packaging of the coil, the prevention of production of flaws on the coil during the handling and the transportation thereof, the handling of the coil even in rain, the transportation of the coil on land without using a special wagon for coils, the improvement of the transporting efficiency of the coil, the manufacture of the container at a low cost with a simple structure free from trouble, and the prevention of production of rust on the coil through the prevention of rain water or sea water from penetrating into the container, but a container having such properties has not as yet been proposed.

SUMMARY OF THE INVENTION

An object of the present invention is therefore to provide a container for housing a coil, which permits the simplification of packaging of the coil, the prevention of production of flaws on the coil during the handling and the transportation thereof, the handling of the coil even in rain, the transportation of the coil on land without using a special wagon for coils, the improvement of the transporting efficiency of the coil, the manufacture of the container at a low cost with a simple structure free from trouble, and the prevention of production of rust on the coil through the prevention of rain water or sea water from penetrating into the container.

In accordance with one of the features of the present invention, there is provided a container for housing a coil, which comprises:

a lower box (2) made of steel for housing a coil with the axis thereof directed horizontally and covering a lower half portion thereof, said lower box (2) comprising a rectangular bottom wall (5), four lower side walls (6*a*, 6*b*, 6*c*, 6*d*), an open upper end, and four lower props (7), having an L-shaped cross section, each fixed vertically to each of four corners of said bottom wall (5), and said four lower side walls (6*a*, 6*b*, 6*c*, 6*d*) and said four lower props (7) having a height slightly larger than a half that of said coil;

an upper box (3) made of steel having a rectangular cross section, inserted outside said lower box (2) so as to be vertically movable along said four lower props (7) of said lower box (2), for covering an upper half portion of said coil, said upper box (3) comprising four upper side walls (16*a*, 16*b*, 16*c*, 16*d*), an open lower end, four upper props (17), having an L-shaped cross section, each fixed vertically to each of four corners of said upper box (3), and an upper end which is openable and closeable by means of a pair of cover plates (4, 4'), each of said pair of cover plates (4, 4') being attached, so as to be openable and closeable by means of at least one hinge (29), to an upper end of each of said two opposing upper side walls (16*c*, 16*d*) of said upper box (3), which are parallel to the axis of said coil housed with the axis thereof directed horizontally in said lower box (2), and said four upper side walls (16*a*, 16*b*, 16*c*, 16*d*) and said four upper props (17) having a height slightly larger than a half that of said coil, whereby, when said upper box (3) is at the uppermost position thereof, a lower end portion of said upper box (3) overlaps an upper end portion of said lower box (2); and a fixing mechanism for securing said upper box (3) at the uppermost position thereof onto said lower box (2), said fixing mechanism comprising four upper pinning holes (13) each provided in an upper end portion of each of said four lower props (7) of said lower box (2), another four pinning holes (23) each provided in a lower portion of each of said four upper props (17) of said upper box (3) and cooperating with each of said four upper pinning holes (13), and four pins (26) each to be releasably inserted into each cooperating set of said upper pinning hole (13) and said another pinning hole (23).

DETAILED DESCRIPTION OF THE PREFERRED EMBODIMENTS

Figure 1:
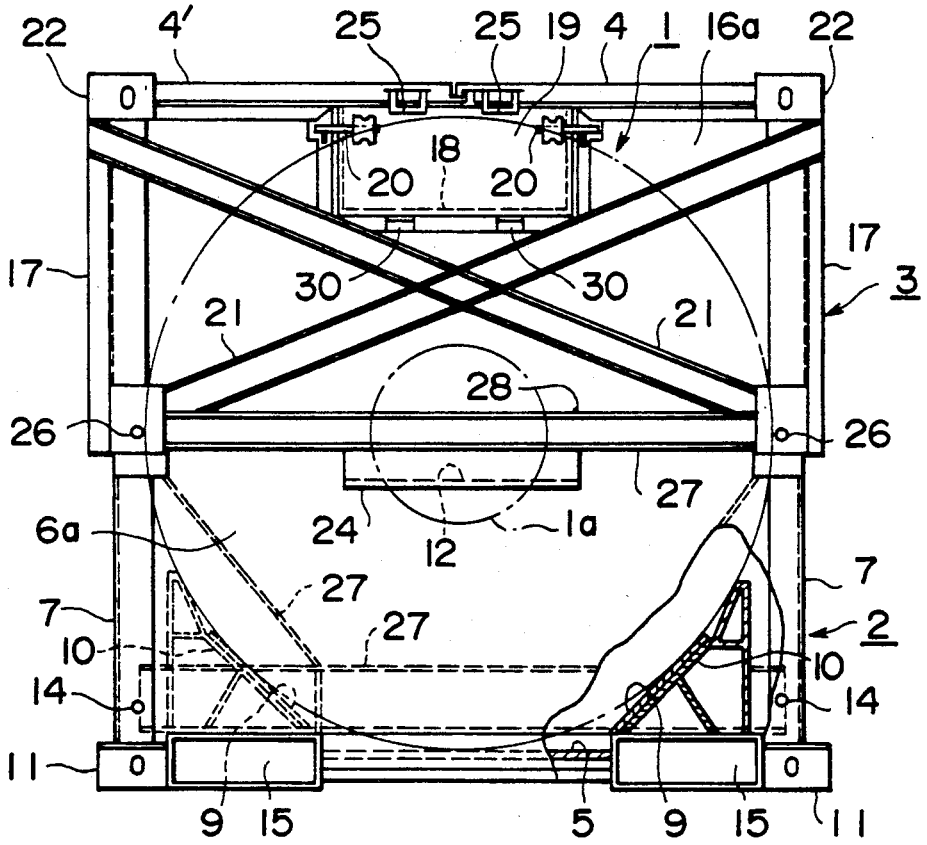
FIG. 1 is a partially cutaway schematic front view illustrating an embodiment of the container of the present invention.
Figure 2:
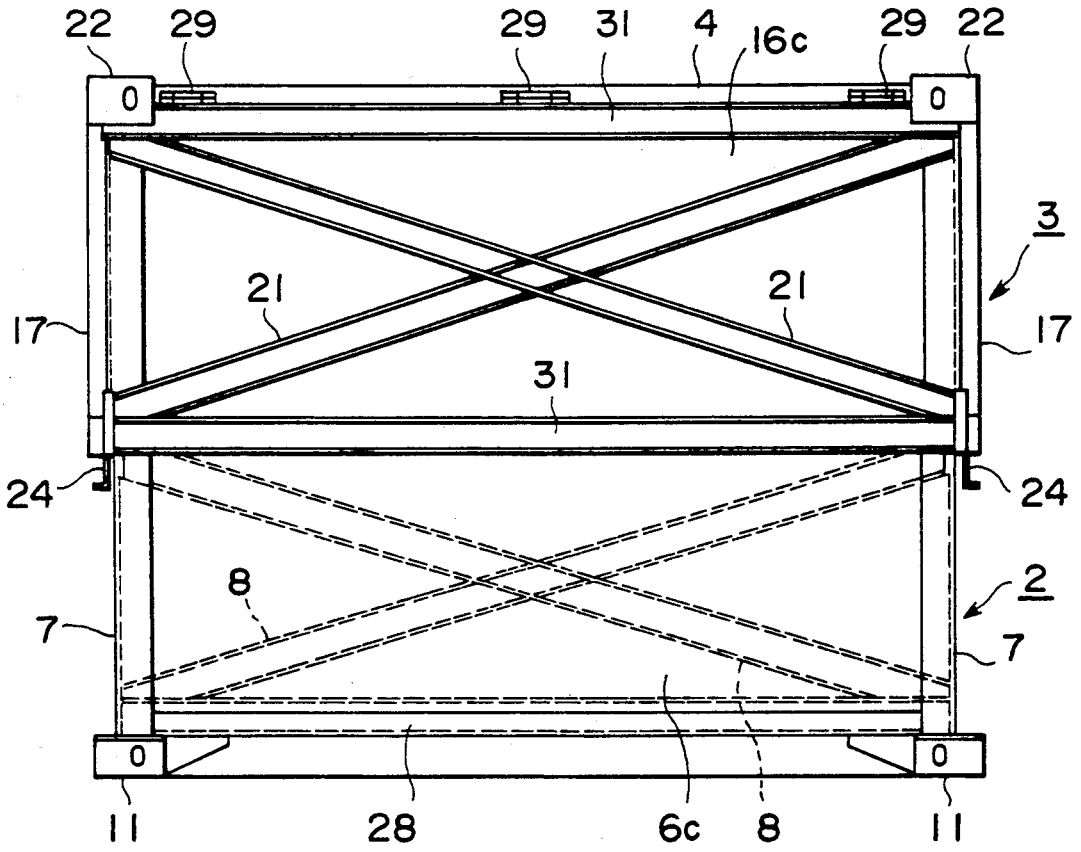
FIG. 2 is a schematic side view of the container of the present invention shown in FIG. 1.
Figure 3:
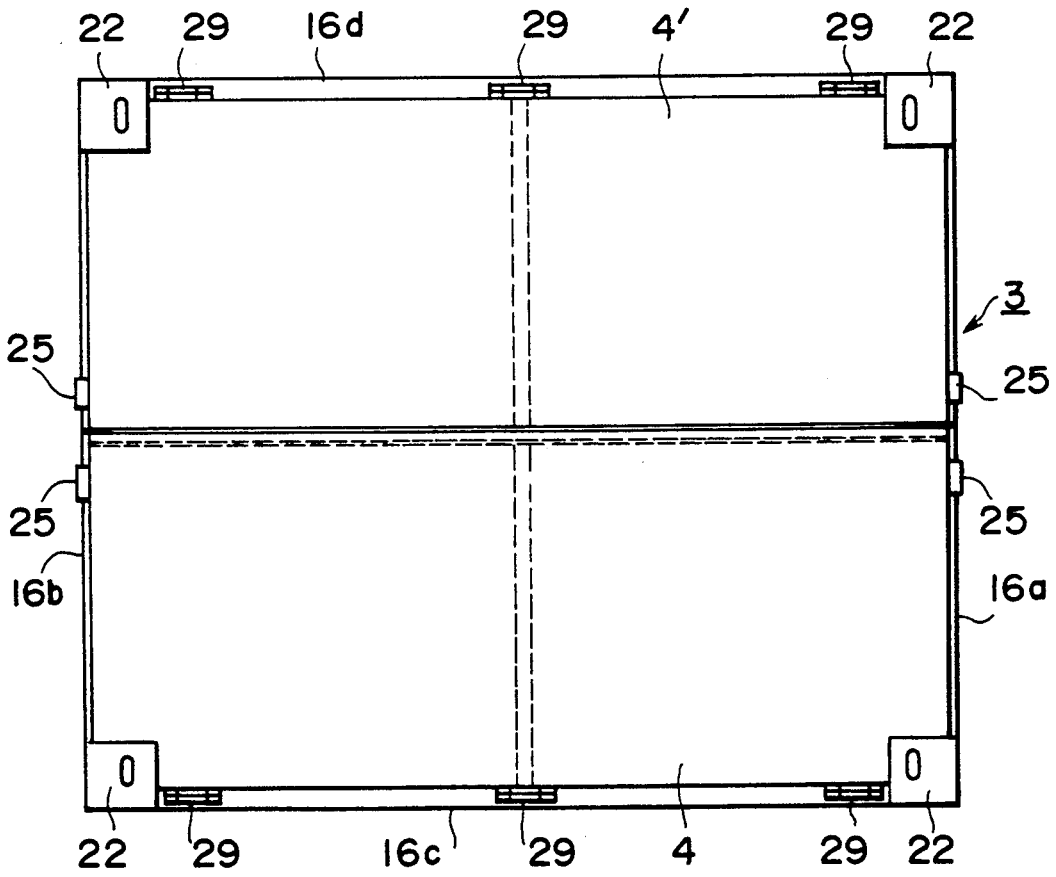
FIG. 3 is a schematic plan view of the container of the present invention shown in FIG. 1.

From the above-mentioned point of view, extensive studies were carried out to develop a container for housing a coil, which permits the simplification of packaging of the coil, the prevention of production of flaws on the coil during the handling and the transportation thereof, the handling of the coil even in rain, the transportation of the coil on land without using a special wagon for coils, the improvement of the transporting efficiency of the coil, the manufacture of the container at a low cost with a simple structure free from trouble, and the prevention of production of rust on the coil through prevention of rain water or sea water from penetrating into the container.

As a result, the following findings were obtained: it is possible to achieve a simple structure of the container free from trouble, to manufacture the container at a low cost, to prevent rain water or sea water from penetrating into the container, and hence to prevent the production of rust on the coil housed in the container, if the container for housing a coil comprises a lower box made of steel, having a bottom wall and an open upper end, for housing the coil with the axis thereof directed horizontally and covering a lower half portion thereof; an upper box made of steel, inserted outside the lower box so as to be vertically movable, for covering an upper half portion of the coil, which has an open lower end and an upper end which is openable and closeable by means of a pair of cover plates; and a fixing mechanism for securing the upper box at the uppermost position thereof onto the lower box.

The present invention was made on the basis of the above-mentioned findings. An embodiment of the container for housing a coil of the present invention is described below with reference to FIGS. 1 to 6.

The container for housing a coil of the present invention comprises, as shown in FIGS. 1 to 6, a lower box 2 made of steel for housing, for example, a metal strip coil 1 with the axis thereof directed horizontally and covering a lower half portion thereof, an upper box 3 made of steel, inserted outside the lower box 2 so as to be vertically movable, for covering an upper half portion of the coil 1, and a fixing mechanism for securing the upper box 3 at the uppermost position thereof onto the lower box 2.

The lower box 2 comprises a rectangular bottom wall 5 made of a steel sheet, four lower side walls 6*a*, 6*b*, 6*c*, 6*d* made of a steel sheet, an open upper end, and four lower props 7 made of steel, having an L-shaped cross section, each fixed vertically to each of four corners of the bottom wall 5.

The bottom wall 5 has an area sufficient to house the coil 1 with the axis thereof directed horizontally. The four lower side walls 6*a*, 6*b*, 6*c*, 6*d* and the four lower props 7 have a height slightly larger than a half that of the coil 1. A pair of coil supports 9 made of a steel sheet for stationarily supporting the coil 1 housed in the lower box 2 are provided on the bottom wall 5. Each of the pair of coil supports 9 is reinforced by a plurality of brackets 10. A lower corner fitting 11 is attached to the lower end of each of the four lower props 7. In the drawings, 15 are pair of holes for insertion of forks of a forklift.

A lower notch 12, which has a size sufficient to expose a greater part of the central hole 1*a* of the coil 1 housed with the axis thereof directed horizontally in the lower box 2, is provided at the center of an upper end portion of each of the two opposing lower side walls 6*a*, 6*b* of the lower box 2, which are perpendicular to the axis of the coil 1. A plurality of braces 8 for reinforcement are provided on the inner surface of each of the other two opposing lower side walls 6*c*, 6*d* of the lower box 2. In the drawings, 27 is a frame of each of the two opposing lower side walls 6*a*, 6*b*, and 28 is another frame of each of the other two opposing lower side walls 6*c*, 6*d*.

The upper box 3 has a rectangular cross section. The upper box 3 comprises four upper side walls 16*a*, 16*b*, 16*c*, 16*d* made of a steel sheet, an open lower end, four upper props 17 made of steel, having an L-shaped cross section, each fixed vertically to each of four corners of the upper box 3, and an upper end which is openable and closeable by means of a pair of cover plates 4, 4' made of steel.

The upper box 3 is inserted outside the lower box 2 so as to be vertically movable along the four lower props 7 of the lower box 2. The four upper side walls 16*a*, 16*b*, 16*c*, 16*d* and the four upper props 17 of the upper box 3 have a height slightly larger than a half that of the coil 1, whereby, when the upper box 3 is at the uppermost position thereof, a lower end portion of the upper box 3 overlaps an upper end portion of the lower box 2.

The upper box 3 is vertically moved along the four props 7 of the lower box 2 by hoisting up and down the upper box 3 by means of a crane, for example. To facilitate such vertical movement of the upper box 3, rollers or the like not shown are provided on the inner surface of each of the four upper props 17 of the upper box 3. An upper corner fitting 22 is attached to the upper end of each of the four upper props 17. A plurality of braces 21 for reinforcement are provided on the outer surface of each of the four upper side walls 16*a*, 16*b*, 16*c*, 16*d*. In the drawings, 31 is a frame of each of the four side walls 16*a*, 16*b*, 16*c*, 16*d*.

Each of the pair of cover plates 4, 4' is attached, so as to be openable and closeable by means of at least one hinge 29, to an upper end of each of the two opposing upper side walls 16*c*,16*d* of the upper box 3, which are parallel to the axis of the coil 1 housed with the axis thereof directed horizontally in the lower box 2. Leading ends of the pair of cover plates 4, 4' overlap each other when the cover plates 4, 4' are closed. The upper end of the upper box 3 is therefore closed water-tightly by closing the pair of cover plates 4, 4'.

Figure 6:
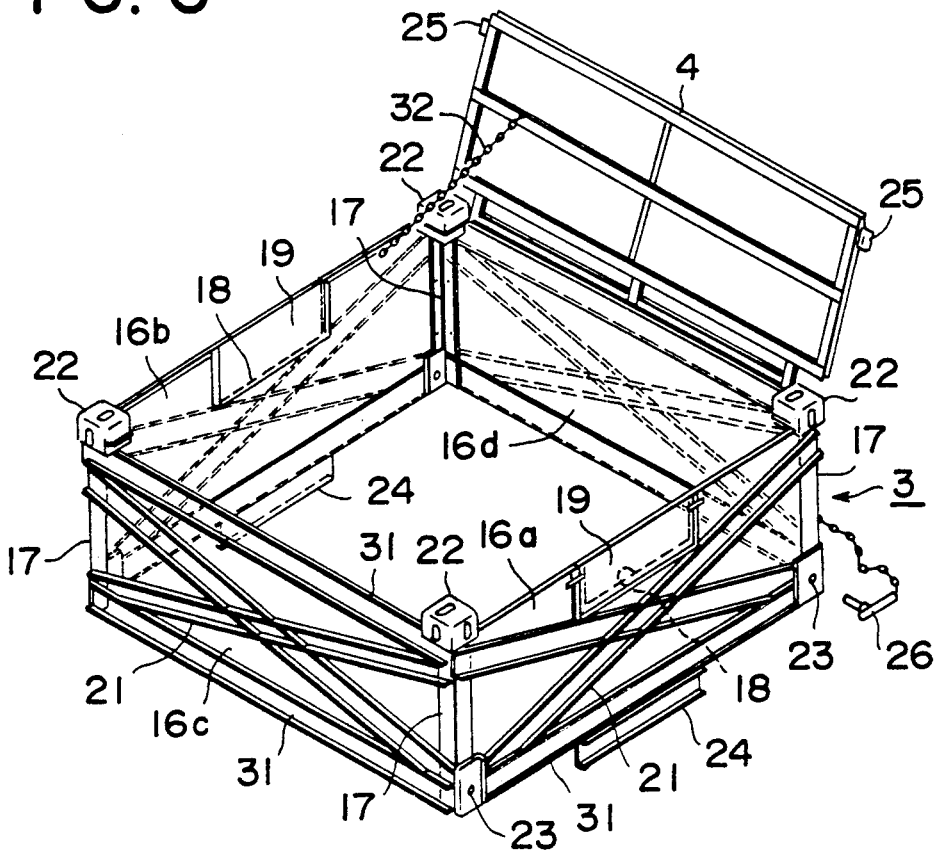
FIG. 6 is a schematic perspective view illustrating the upper box of the container of the present invention shown in FIG. 1, in a state in which one of the cover plates is open, and the other one of the coverplates is omitted.
Figure 7:
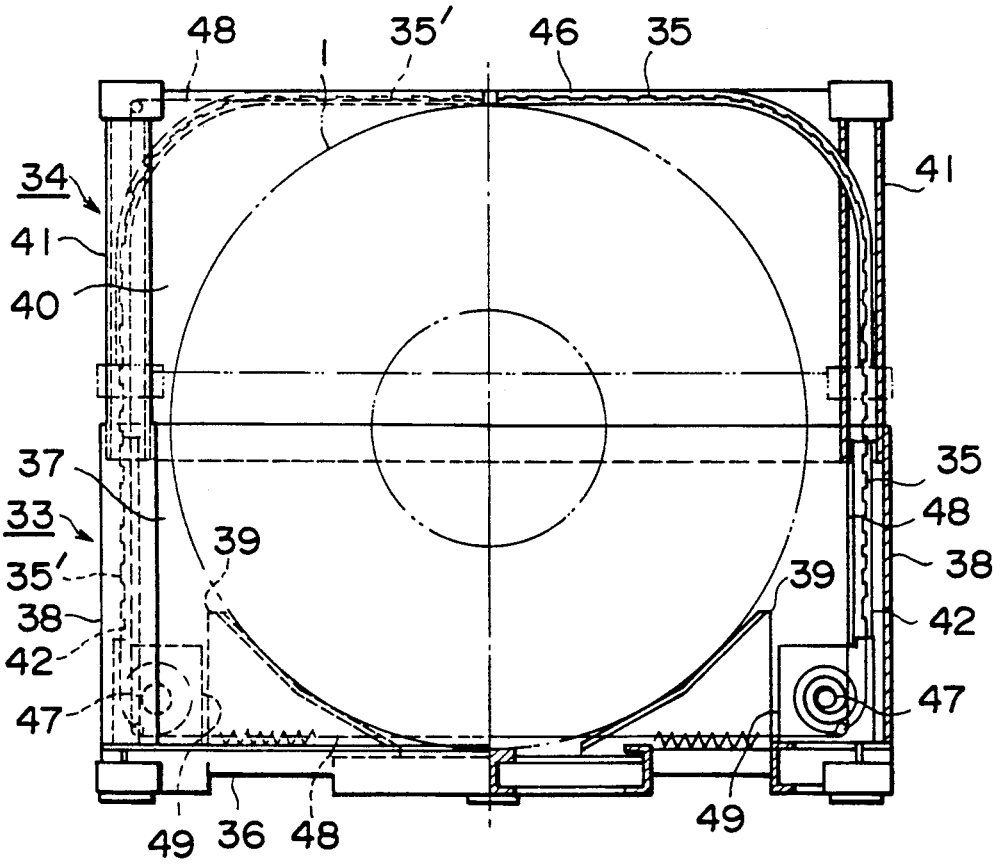
FIG. 7 is a partially cutaway schematic front view illustrating the container of the prior art.
Figure 8:
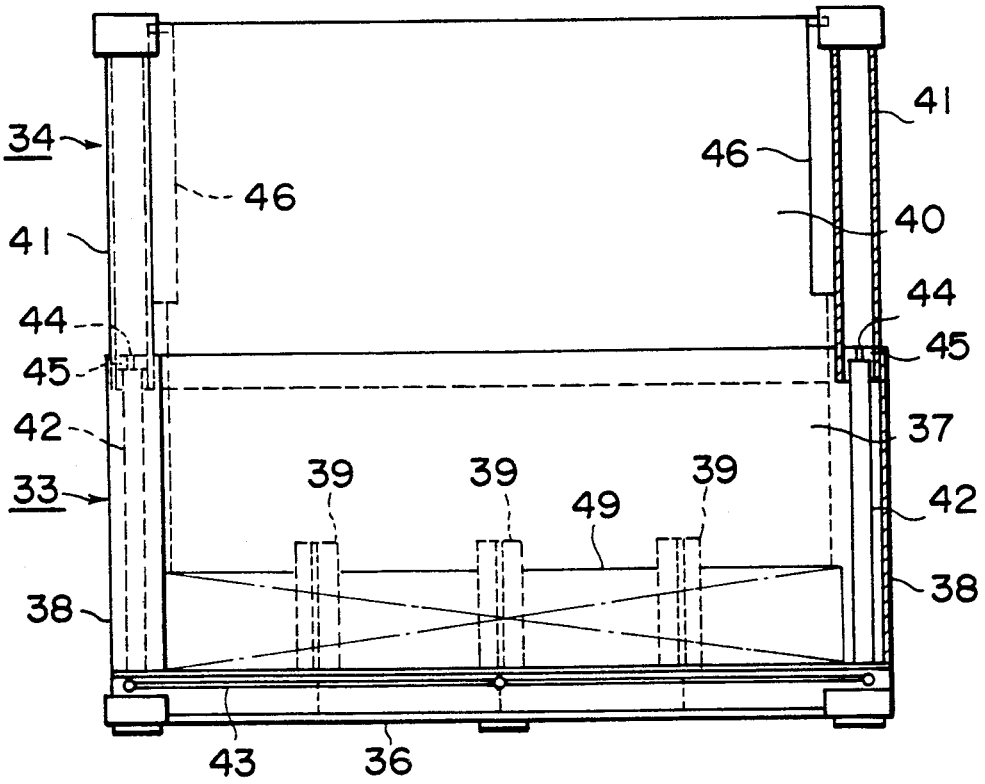
FIG. 8 is a partially cutaway schematic side view illustrating the container of the prior art shown in FIG. 7.

The pair of cover plates 4, 4' are opened and closed manually. For this purpose, a grip 25 is fixed to each of the both sides of the leading end of each of the pair of cover plates 4, 4'. In FIG. 6, 32 is a chain for holding each of the opened cover plates 4, 4' at a certain position, one end of which is attached to a lower surface of each of the cover plates 4, 4' and the other end of which is attached to an upper end portion of each of the upper side walls 16*a*, 16*b*. FIG. 6 illustrates a state in which one of the cover plates 4 is open, and the other one of the cover plates 4' is omitted.

An upper notch 18, which substantially matches with the lower notch 12 provided in each of the two opposing lower side walls 6*a*, 6*b* of the lower box 2, is provided at the center of an upper end portion of each of the two respectively correspond to the two opposing lower side walls 6*a*, 6*b* of the lower box 2. A greater part of the central hole 1*a* of the coil 1 housed in the lower box 2 is thus exposed, when the upper box 3 is at the lowermost position thereof.

A closing plate 19, which is openable and closeable, is provided for each of the upper notches 18 of the upper box 3 to close the upper notch 18. The closing plate 19 is attached to each of the two opposing upper side walls 16*a*, 16*b* of the upper box 3 so as to be openable and closeable by means of at least one another hinge 30. Two horizontally movable stoppers 20, for securing each of the closing plates 19 in the closed state thereof to each of the two opposing upper side walls 16*a*, 16*b*, are attached to each of the closing plates 19.

Another closing plate 24 which downwardly projects is fixed to the center of a lower end of each of the two opposing upper side walls 16*a*, 16*b* of the upper box 3, whereby each of the notches 12 of the lower box 2 is closed by means of each of the another closing plates 24 of the upper box 3, when the upper box 3 is at the uppermost position thereof.

The fixing mechanism for securing the upper box 3 at the uppermost position thereof onto the lower box 2, comprises four upper pinning holes 13 each provided in an upper end portion of each of the four lower props 7 of the lower box 2, another four pinning holes 23 each provided in a lower end portion of each of the four upper props 17 of the upper box 3 and cooperating with each of the four upper pinning holes 13, and four pins 26 each to be releasably inserted into each cooperating set of the upper pinning hole 13 and the another pinning hole 23.

The upper box 3 hoisted up to the uppermost position thereof by means of a crane, for example, is secured onto the lower box 2 by inserting each of the four pins 26 into each cooperating set of the upper pinning hole 13 and the another pinning hole 23.

Four lower pinning holes 14, which cooperate with the another four pinning holes 23 each provided in a lower end portion of each of the four upper props 17 of the upper box 3, are provided each in a lower end portion of each of the four lower props 7 of the lower box 2. The upper box 3 hoisted down to the lowermost position thereof by means of a crane, for example, is secured outside the lower box 2 by inserting each of the four pins 26 into each cooperating set of the lower pinning hole 14 and the another pinning hole 23.

Figure 4:
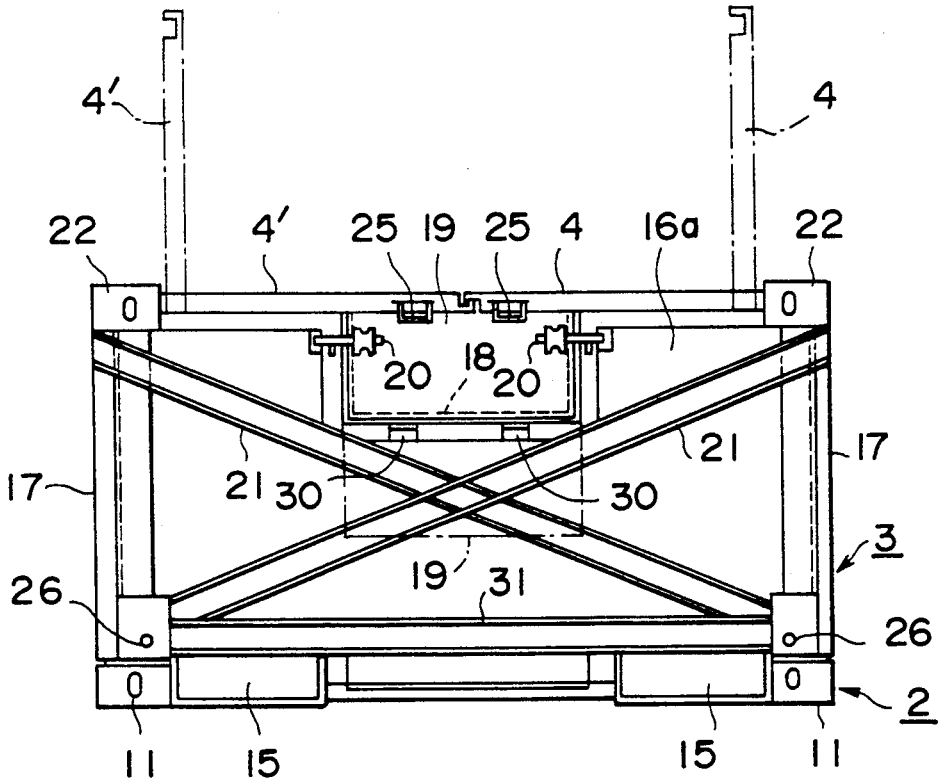
FIG. 4 is a schematic front view illustrating the container of the present invention shown in FIG. 1, in a state in which the upper box is at the lowermost position thereof.
Figure 5:
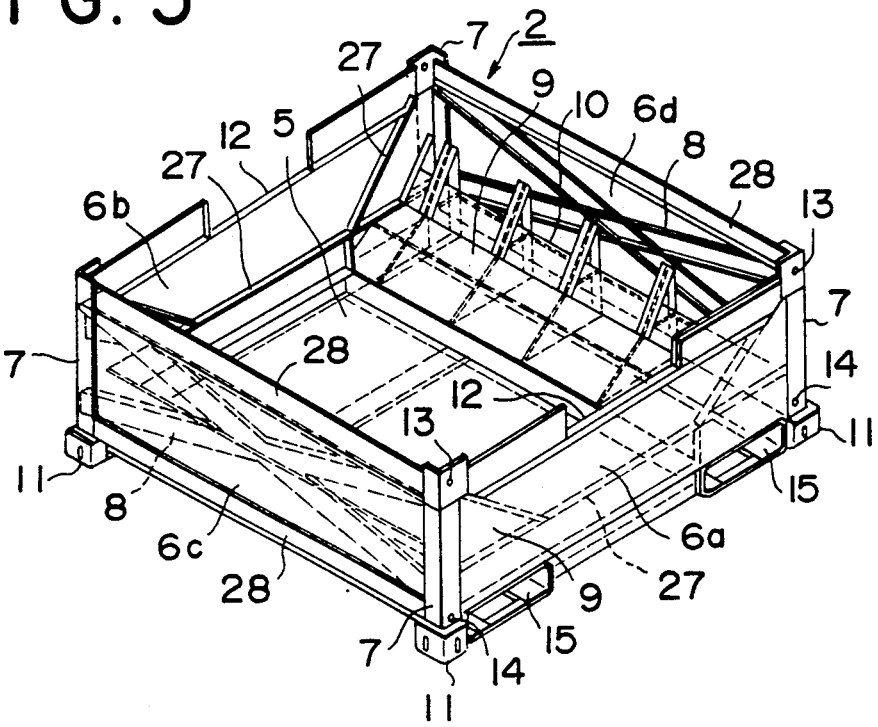
FIG. 5 is a schematic perspective view illustrating the lower box of the container of the present invention shown in FIG. 1.

According to the container for housing a coil of the present invention as described above, the coil 1 is housed in the container as follows. As shown in FIG. 4, the pair of cover plates 4, 4' at the upper end of the upper box 3, which is at the lowermost position thereof and inserted outside the lower box 2, are opened manually as shown by an one-point chain line to open the upper end of the upper box 3. Then, the closing plate 19, which closes the upper notch 18 provided at the center of the upper end portion of each of the two opposing upper side walls 16*a*, 16*b* of the upper box 3, is opened to open the upper notches 18.

In this state, the coil 1 is housed with the axis thereof directed horizontally in the lower box 2, by means of a crane, for example, and the coil 1 is supported by means of the pair of coil supports 9 provided on the bottom wall 5 of the lower box 2 and is stationarily fixed by means of a rope or the like not shown.

The container in this state has a height slightly larger than a half that of the coil 1. However, a greater part of the central hole 1*a* of the coil 1 housed in the lower box 2 is exposed because of the presence of the lower notches 12 each provided at the center of the upper end portion of each of the two opposing lower side walls 6*a*, 6*b* of the lower box 2, and the upper notches 18, which substantially match with the above-mentioned lower notches 12, each provided at the center of the upper end portion of each of the two opposing upper side walls 16*a*, 16*b* of the upper box 3. The coil 1 can therefore easily be housed in the lower box 2 with the use of a crane or a lifter.

Then, the upper box 3 is hoisted up by means of a crane or the like to the uppermost position thereof, at which the another four pinning holes 23 each provided in the lower end portion of each of the four upper props 17 of the upper box 3 match with the four upper pinning holes 13 each provided on the upper end portion of each of the four lower props 7 of the lower box 2. Then, the upper box 3 is secured onto the lower box 2 by inserting each of the four pins 26 into each cooperating set of the upper pinning hole 13 of the lower box 2 and the another pinning hole 23 of the upper box 3.

Then, the upper end of the upper box 3 is closed by manually closing the pair of cover plates 4, 4' provided at the upper end of the upper box 3. Then, the upper notches 18 of the upper box 3 are closed by closing the closing plates 19 provided for the upper notches 18, and each of the closing plates 19 in the closing state thereof is secured to each of the two opposing upper side walls 16*a*, 16*b* upper box 3 by means of the two stoppers 20. The lower notch 12 provided at the center of the upper end portion of each of the two opposing lower side walls 6*a*, 6*b* of the lower box 2 is closed by means of the another closing plate 24, which downwardly projects, fixed to the center of the lower end of each of the two opposing upper side walls 16*a*, 16*b* of the upper box 3. The upper half portion of the coil 1 is thus covered by the upper box 3, and the coil 1 is completely housed in the container.

The container in which the coil 1 is housed as described above is transported by sea and on land to the final destination, where the coil 1 is taken out from the container as follows. The upper end of the upper box 3 is opened by manually opening the pair of cover plates 4, 4' provided at the open end of the upper box 3. The upper box 3 is then slightly hoisted up by means of a crane. Then, each of the four pins 26 is pulled out from each cooperating set of the upper pinning hole 13 of the lower box 2 and the another pinning hole 23 of the upper box 3. Then, the upper box 3 is hoisted down by means of the crane to the lowermost position thereof, i.e., to outside the lower box 2 along the four lower props 7 of the lower box 2.

Then, the upper notches 18 of the upper box 3 are opened by opening the closing plate 19, which closes the upper notch 18 of each of the two opposing upper side walls 16*a*, 16*b* of the upper box 3. The upper half portion of the coil 1 is thus exposed to outside the container, and a greater part of the central hole 1*a* of the coil 1 is exposed through the upper notch 18 of each of the two opposing upper side walls 16*a*, 16*b* of the upper box 3 and the lower notch 12 of each of the two opposing lower side walls 6*a*, 6*b* of the lower box 2. It is therefore possible to easily take out the coil 1 from the lower box 2 with the use of a crane or a lifter.

After the coil 1 is thus taken out from the lower box 2, the upper end of the upper box 3 is closed by manually closing the pair of cover plates 4, 4' provided at the upper end of the upper box 3. Then, the upper notches 18 of the upper box 3 are closed by closing the closing plates 19 provided for the upper notches 18, and each of the closing plates 19 in the closing state thereof is secured to each of the two opposing upper side walls 16*a*, 16*b* of the upper box 3 by means of the two stoppers 20. Then, the upper box 3 at the lowermost position thereof is secured outside the lower box 2 by inserting each of the four pins 26 into each cooperating set of the another pinning hole 23 provided in the lower end portion of each of the four upper props 17 of the upper box 3 and the lower pinning hole 14 provided in the lower end portion of each of the four lower props 7 of the lower box 2. A plurality of vacant (i.e., empty) containers in such states are piled up for return to the starting place.

As described above, the container of the present invention comprises a lower box 2 made of steel, having a bottom wall and an open upper end, for housing a coil with the axis thereof directed horizontally and covering a lower half portion thereof; an upper box 3 made of steel, inserted outside the lower box 2 so as to be vertically movable, for covering an upper half portion of the coil, which has an open lower end and an upper end which is openable and closeable by means of a pair of cover plates 4, 4'; and a fixing mechanism for securing the upper box 3 at the uppermost position thereof onto the lower box 2. According to the container of the present invention, therefore, it is possible to achieve a simple structure of the container free from trouble, to manufacture the container at a low cost, and to prevent rain water or sea water from penetrating into the container, and hence to prevent the production of rust on the coil housed in the container.

According to the present invention, as described above in detail, it is possible to provide a container for housing a coil, which permits the simplification of packaging of the coil, the prevention of production of flaws on the coil during the handling and the transportation thereof, the handling of the coil even in rain, the transportation of the coil on land without using a special wagon for coils, the improvement of the transporting efficiency of the coil, the manufacture of the container at a low cost with a simple structure free from trouble, and the prevention of production of rust on the coil through the prevention of rain water or sea water from penetrating into the container, thus providing many industrially useful effects.

What is claimed is:

1. A container for housing a coil, which comprises:

a lower box (2) made of steel for housing a coil with the axis thereof directed horizontally and covering a lower half portion thereof, said lower box (2) comprising a rectangular bottom wall (5), four lower side walls (6*a*, 6*b*, 6*c*, 6*d*), an open upper end, and four lower props (7), having an L-shaped cross section, each fixed vertically to each of four corners of said bottom wall (5), and said four lower side walls (6*a*, 6*b*, 6*c*, 6*d*) and said four lower props (7) having a height slightly larger than a half that of said coil;

an upper box (3) made of steel having a rectangular cross section, inserted outside said lower box (2) so as to be vertically movable along said four lower props (7) of said lower box (2), for covering an upper half portion of said coil, said upper box (3) comprising four upper side walls (16*a*, 16*b*, 16*c*, 16*d*), an open lower end, four upper props (17), having an L-shaped cross section, each fixed vertically to each of four corners of said upper box (3), and an upper end which is openable and closeable by means of a pair of cover plates (4, 4'), each of said pair of cover plates (4, 4') being attached, so as to be openable and closeable by means of at least one hinge (29), to an upper end of each of said two opposing upper side walls (16*c*, 16*d*) of said upper box (3), which are parallel to the axis of said coil housed with the axis thereof directed horizontally in said lower box (2), and said four upper side walls (16*a*, 16*b*, 16*c*, 16*d*) and said four upper props (17) having a height slightly larger than a half that of said coil, whereby, when said upper box (3) is at the uppermost position thereof, a lower end portion of said upper box (3) overlaps an upper end portion of said lower box (2); and a fixing mechanism for securing said upper box (3) at the uppermost position thereof onto said lower box (2), said fixing mechanism comprising four upper pinning holes (13) each provided in an upper end portion of each of said four lower props (7) of said lower box (2), another four pinning holes (23) each provided in a lower portion of each of said four upper props (17) of said upper box (3) and cooperating with each of said four upper pinning holes (13), and four pins (26) each to be releasably inserted into each cooperating set of said upper pinning hole (13) and said another pinning hole (23).

2. A container as claimed in claim 1, wherein:

a lower notch (12), which has a size sufficient to expose a greater part of the central hole of said coil housed with the axis thereof directed horizontally in said lower box (2), is provided at the center of an upper end portion of each of said two opposing lower side walls (6*a*, 6*b*) of said lower box (2), which are perpendicular to the axis of said coil;

an upper notch (18), which substantially matches with said lower notch (12) provided in each of said two opposing lower side walls (6*a*, 6*b*) of said lower box (2), is provided at the center of an upper end portion of each of said two opposing upper side walls (16*a*, 16*b*) of said upper box (3), which respectively correspond to said two opposing lower side walls (6*a*, 6*b*) of said lower box (2), whereby, a greater part of the central hole of said coil housed in said lower box (2) is exposed, when said upper box (3) is at the lowermost position thereof;

a closing plate (19), which is openable and closeable, is provided for each of said upper notches (18) of said upper box (3) to close said upper notch (18); and another closing plate (24), which downwardly projects, is fixed to the center of a lower end of each of said two opposing upper side walls (16*a*, 16*b*) of said upper box (3), whereby each of said notches (12) of said lower box (2) is closed by means of each of said another closing plates (24) of said upper box (3), when said upper box (3) is at the uppermost position thereof.

* * * * *